United States Patent [19]

Black, III et al.

[11] 4,169,972

[45] Oct. 2, 1979

[54] ELECTRICAL SWITCHES WITH ROCKER ACTION

[75] Inventors: Charles E. Black, III, Mt. Prospect; Andrew F. Raab, Morton Grove, both of Ill.

[73] Assignee: Indak Manufacturing Corp., Northbrook, Ill.

[21] Appl. No.: 868,268

[22] Filed: Jan. 10, 1978

[51] Int. Cl.[2] ..... H01H 23/14

[52] U.S. Cl. ..... 200/153 K; 200/67 C; 200/315; 200/339

[58] Field of Search ..... 200/153 K, 315, 339, 200/67 C

[56] References Cited

U.S. PATENT DOCUMENTS

| | | | |
|---|---|---|---|
| 3,235,679 | 2/1966 | Schaad et al. | 200/16 |
| 3,299,227 | 1/1967 | Schaad et al. | 200/16 |
| 3,598,950 | 8/1971 | Ohashi | 200/315 |
| 3,604,863 | 9/1971 | Schiak | 200/16 R |
| 3,668,353 | 6/1972 | Raab | 200/153 K |
| 4,064,380 | 12/1977 | Matthews | 200/315 X |

FOREIGN PATENT DOCUMENTS

| | | | |
|---|---|---|---|
| 1571558 | 6/1969 | France | 200/339 |
| 1448561 | 9/1976 | United Kingdom | 200/315 |

*Primary Examiner*—Charles E. Phillips
*Attorney, Agent, or Firm*—Burmeister, York, Palmatier, Hamby & Jones

[57] ABSTRACT

The electrical switch comprises a resinous plastic casing, a carriage slidable in the casing, at least one contactor mounted on the carriage and movable therewith, contact means in the casing and selectably engageable by the contactor, a resinous plastic rocker plate rockably mounted on the front of the casing and having a lever arm swingable with the rocker plate for causing sliding movement of the carriage in response to rocking movement of the rocker plate, the carriage having a slot for receiving the lever arm, a pair of spaced parallel side walls on the casing and having pivot receiving openings, a pair of flexible resilient generally parallel pivot support tabs projecting rearwardly from the rocker plate and having pivot elements pivotally received in the openings for rockably supporting the rocker plate, the pivot elements being insertable into said openings by flexure of the pivot support tabs, a pair of oppositely inclined stop surfaces on the casing and engageable by the rocker plate at the opposite extremes of its rocking movement, a torsion return spring comprising a wire coil with opposite end arms extending therefrom, the casing having a pocket for receiving the coil and slots for receiving the end arms with the spring prestressed, a pair of spring operating tabs projecting rearwardly on the rocker plate for engaging and swinging the opposite end arms of the spring when the rocker plate is swung in opposite directions from a central position, a lamp in the casing for illumination in at least one position of said contactor, and a cover shell mounted on the front of said rocker plate and having a light transmitting element, the rocker plate having an opening therein for transmitting light between the lamp and the light transmitting element.

4 Claims, 77 Drawing Figures

ON
REAR
DEFOG
OFF

JEWEL INDICATOR LAMP
OFF
NEUTRAL
ON
12V. DC

UP
POWER
ANTENNA
DOWN

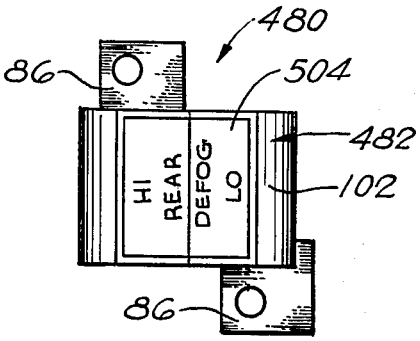
FIG. 65
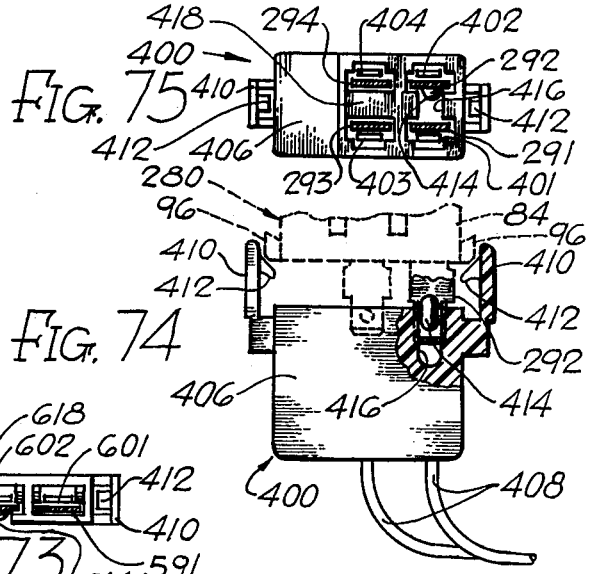
FIG. 75
FIG. 74
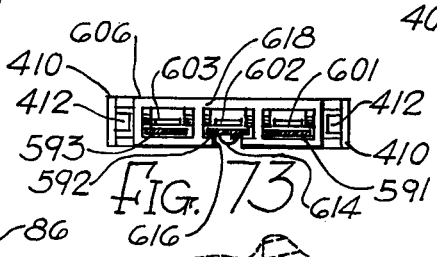
FIG. 73
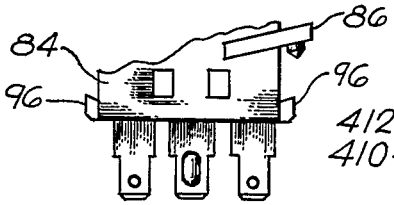
FIG. 66
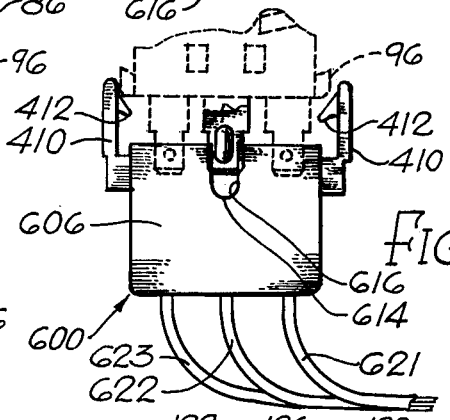
FIG. 72
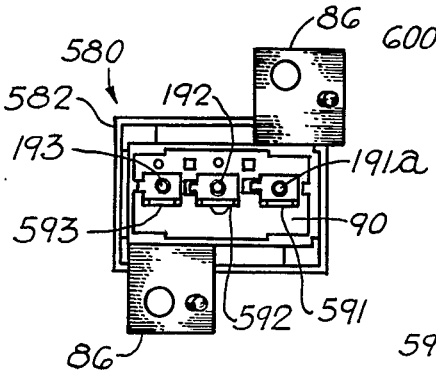
FIG. 67
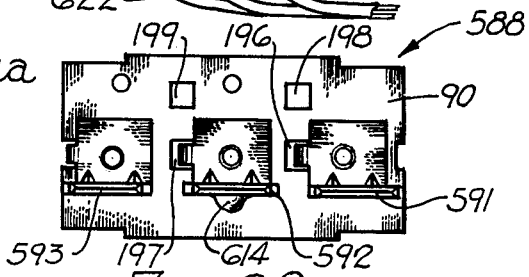
FIG. 68
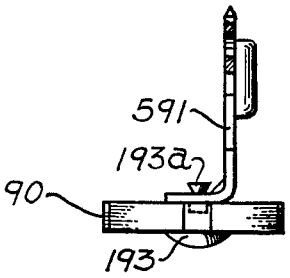
FIG. 70
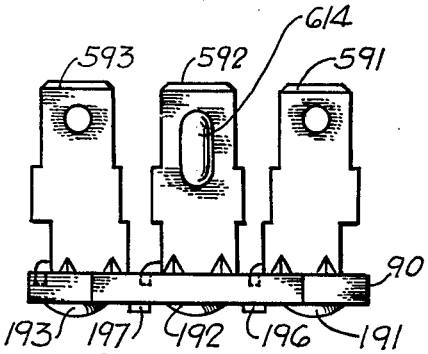
FIG. 69
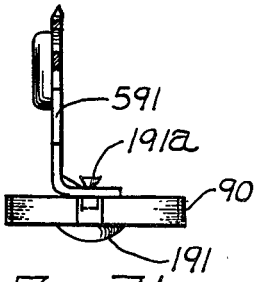
FIG. 71

ELECTRICAL SWITCHES WITH ROCKER ACTION

This invention relates to electrical switches having operating members in the form of rockers.

One object of the present invention is to provide a new and improved electrical switch having a rocker with a separate cover shell mounted thereon, so that a series of different cover shells can be employed to produce different versions of the switch, without any change in the basic rocker construction.

A further object is to provide a new and improved electrical switch in which the rocker can easily be assembled on the casing of the switch, by pushing it into place without the use of any tools.

Another object is to provide a rocker switch having new and improved stop means for limiting the rocking movement of the rocker.

A further object is to provide a rocker switch having a return spring which cooperates with the rocker in a new and improved manner.

Another object is to provide a switch having a new and improved construction for illuminating a light transmitting element in the cover shell of the rocker.

To accomplish these objectives, the present invention preferably provides an electrical switch comprising a casing, a carriage slidable in the casing, contactor means mounted on the carriage and movable therewith, contact means in the casing and selectively engageable by the contactor means, a rocker, preferably including a rocker plate, rockably mounted on the casing and having a lever arm swingable with the rocker plate for causing sliding movement of the carriage in response to rocking movement of the rocker plate, the carriage having a slot formation for receiving the lever arm, a pair of spaced generally parallel side walls on the casing and having pivot receiving openings in the side walls, a pair of flexible resilient generally parallel pivot support tabs projecting rearwardly from the rocker plate, and a pair of pivot elements on the respective pivot support tabs and pivotally received in the openings for rockably supporting the rocker plate, the pivot elements being insertable into the openings by flexure of the flexible resilient tabs.

The casing preferably includes a pair of oppositely inclined stop surfaces engageable by the rocker plate at the opposite extremes of its rocking movement.

In certain versions, the switch preferably includes a torsion return spring in the form of a wire coil with opposite end arms extending therefrom, the casing having a pocket formation for receiving the coil and slot formations for receiving the end arms with the spring prestressed, and a pair of spring operating tabs on the rocker for engageing and swinging the opposite end arms of the spring when the rocker is swung in opposite directions from a central position.

In certain versions, the switch preferably includes a lamp in the casing and behind the rocker for illuminating a light transmitting element of a cover shell mounted on the front of the rocker, the rocker having an opening therein for transmitting light between the lamp and the cover shell.

Further objects, advantages and features of the present invention will appear from the following description, taken with the accompanying drawings, in which.

Figure 4:
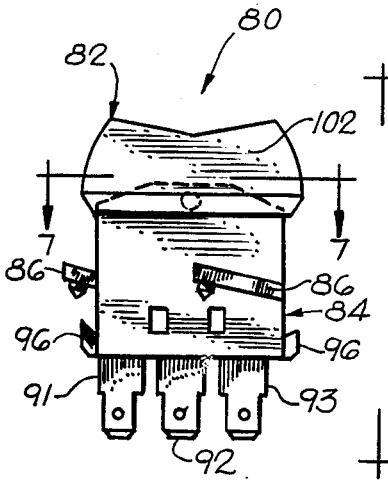
Figure 2:
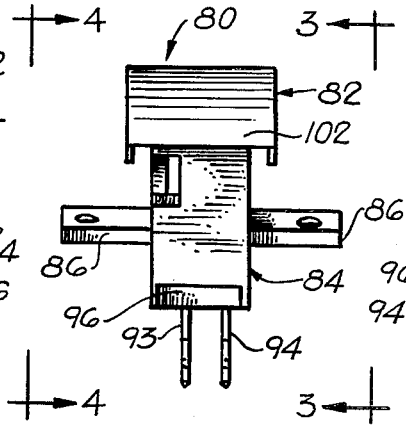
FIG. 2 is a plan view of the switch of FIG. 1.
Figure 3:
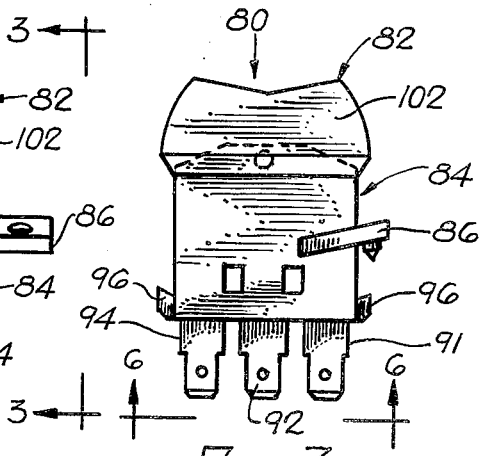

FIGS. 3 and 4 are opposite side views, taken as indicated by the lines 3—3 and 4—4 in FIG. 2.

Figure 5:
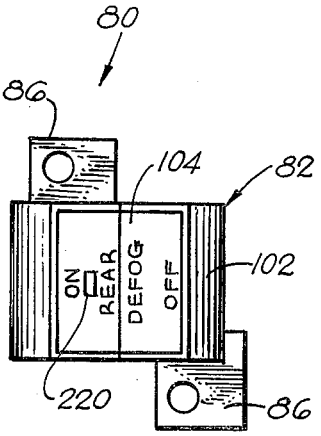

FIG. 5 is a front view of the switch.

Figure 6:
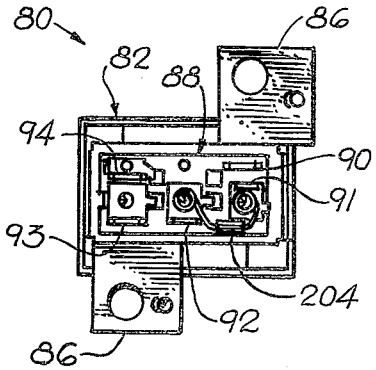

FIG. 6 is a rear view, taken as indicated by the line 6—6 in FIG. 3.

Figure 7:
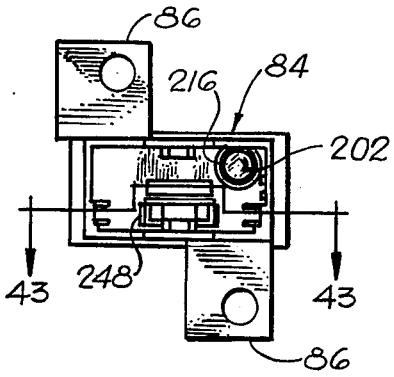

FIG. 7 is a front view of the casing for the switch, with the rocker and the return spring removed, the view being taken generally as indicated by the line 7—7 in FIG. 4.

Figures 8, 8A, 9, 10, 11, 12, 13, 14, 15, 16, 17, 18, 19:
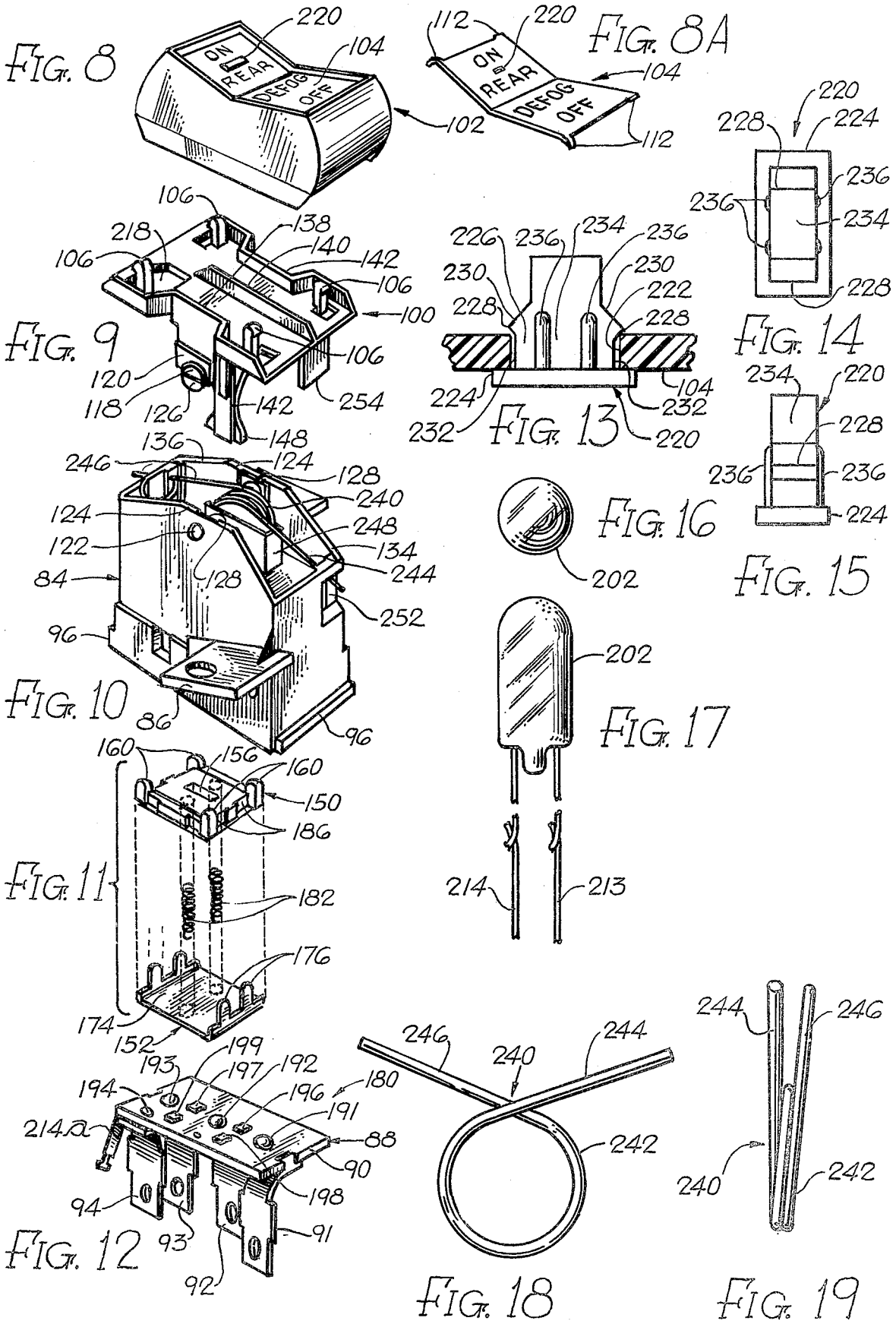

FIG. 8 is a perspective view of the cover shell for the rocker.

FIG. 8A is a perspective view of an insert member for the cover shell.

FIG. 9 is a perspective view of the rocker, with the cover shell removed.

FIG. 10 is a perspective view of the casing, with the rocker removed.

FIG. 11 is an exploded perspective view showing the carriage, the contactor and the contactor springs for the switch.

FIG. 12 is a perspective view showing the terminal head for the switch.

FIG. 13 is a greatly enlarged side view of a light transmitting element or jewel for the rocker.

FIG. 14 is a rear view of the jewel.

FIG. 15 is an edge view of the jewel.

FIGS. 16 and 17 are end and side views of a lamp for the switch.

FIGS. 18 and 19 are enlarged side and edge views of a torsion spring for the switch.

FIGS. 20, 21, 22 and 23 are front, side, edge and rear views of the rocker base or plate for the switch.

Figures 20, 21, 22, 23, 24, 25, 26, 27, 28, 29, 30:
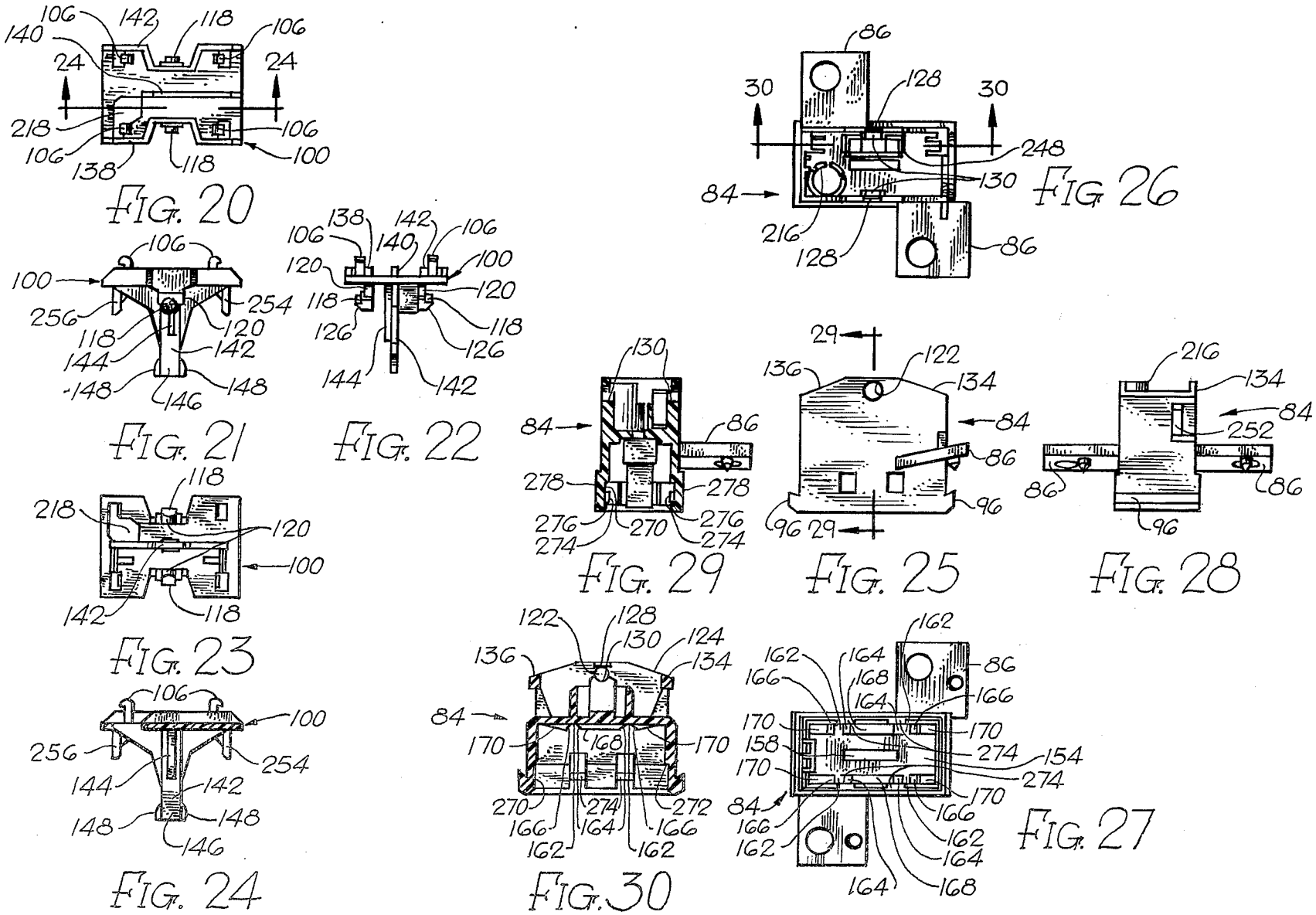

FIG. 24 is a section, taken generally along the line 24—24 in FIG. 20.

FIGS. 25, 26, 27 and 28 are side, front, rear and end views of the casing for the switch.

FIGS. 29 and 30 are sections, taken generally along the lines 29—29 and 30—30 in FIGS. 25 and 26.

Figures 31, 32, 33, 34, 35, 36, 37, 38, 39, 40, 41, 42:
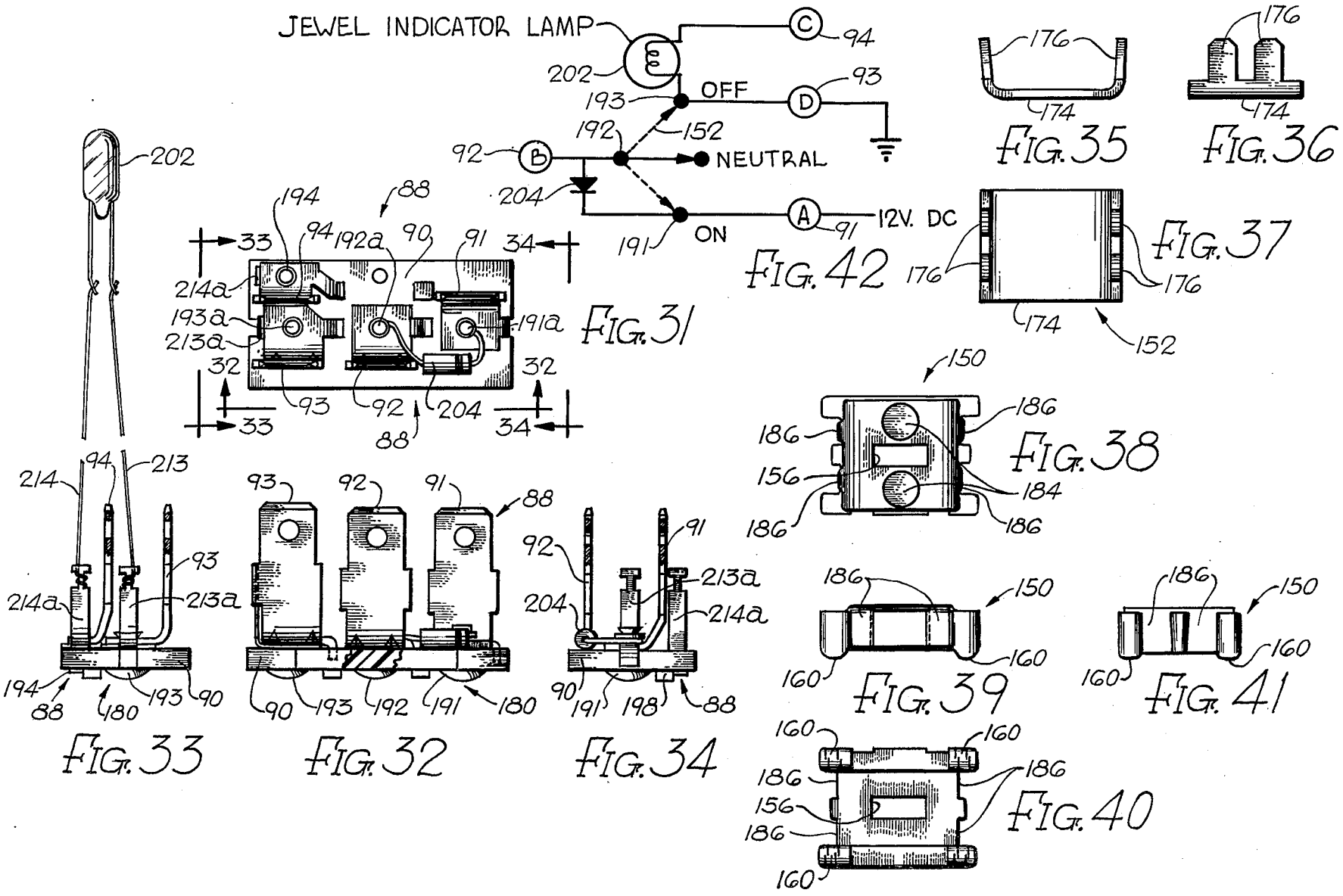

FIG. 31 is an enlarged rear view of the terminal head assembly for the switch.

FIG. 32 is a side view of the terminal head assembly, taken generally as indicated by the line 32—32 in FIG. 31.

FIG. 33 is an end view of the terminal head assembly, showing the connection of the lamp, the view being taken generally as indicated by the line 33—33 in FIG. 31.

FIG. 34 is an opposite end view, taken generally as indicated by the line 34—34 in FIG. 31.

FIGS. 35, 36 and 37 are side, end and front views of the contactor.

FIGS. 38, 39, 40 and 41 are rear, side, front and end views of the carriage for the switch.

Figure 1:
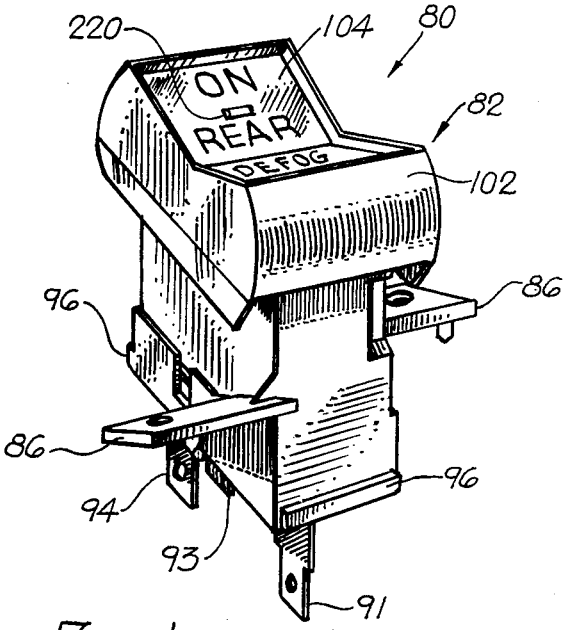
FIG. 1 is a perspective view of an electrical switch to be described as a first illustrative embodiment of the present invention.

FIG. 42 is a schematic circuit diagram for the switch of FIG. 1.

Figures 43, 44, 45, 46:
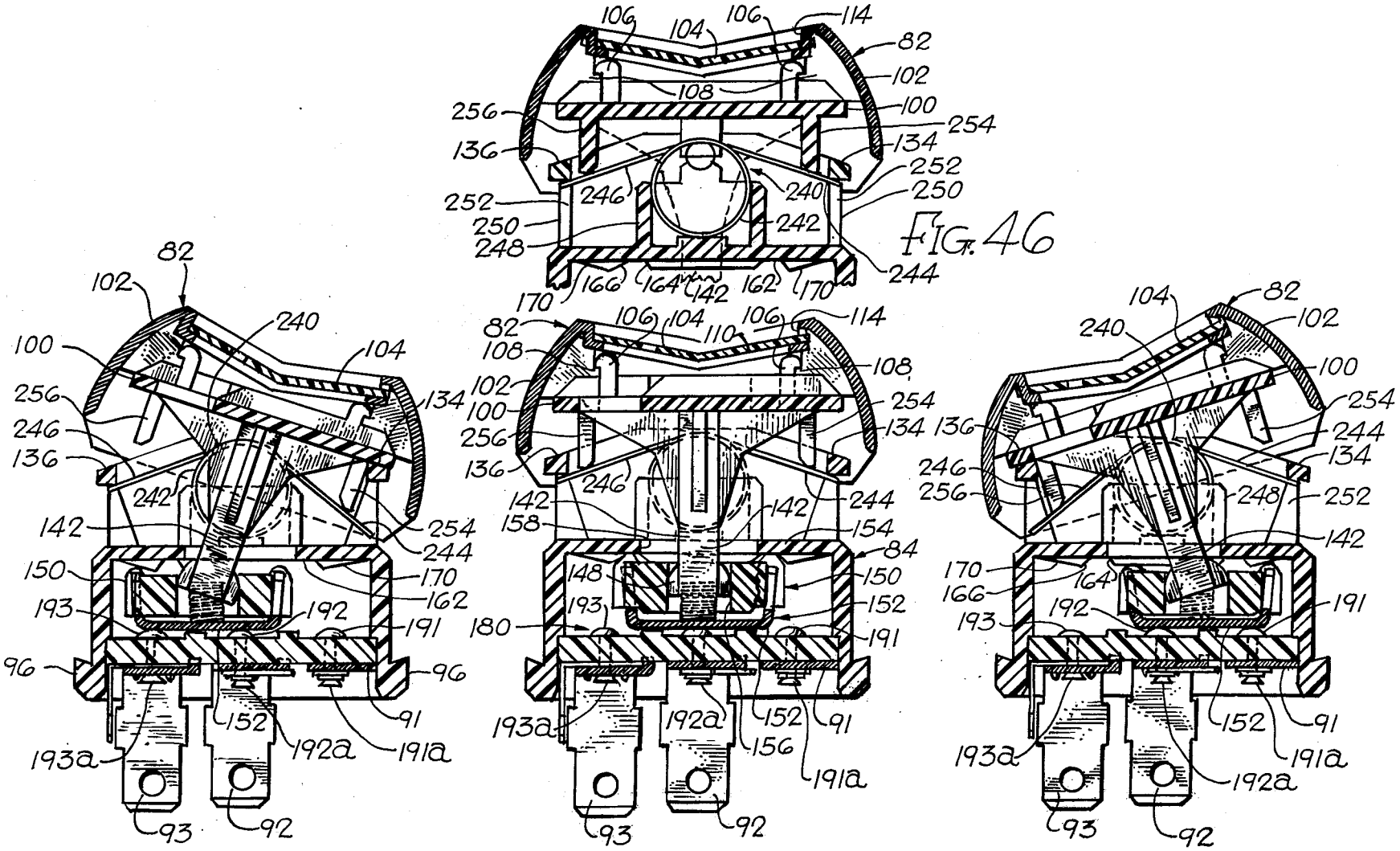

FIG. 43 is an enlarged section through the switch of FIG. 1, taken generally along the broken line 43—43 in FIG. 7, the operating rocker of the switch being shown in its central or neutral position.

FIGS. 44 and 45 are sectional views similar to FIG. 43, but showing the operating rocker in its opposite extremes of rocking movement.

FIG. 46 is a fragmentary section, somewhat similar to FIG. 43, but taken along a slightly different plane to show the return spring more clearly.

Figures 47, 48, 49, 49A, 50, 51, 52, 53, 54, 55, 56, 57, 58, 59, 60, 61, 62, 63, 64:
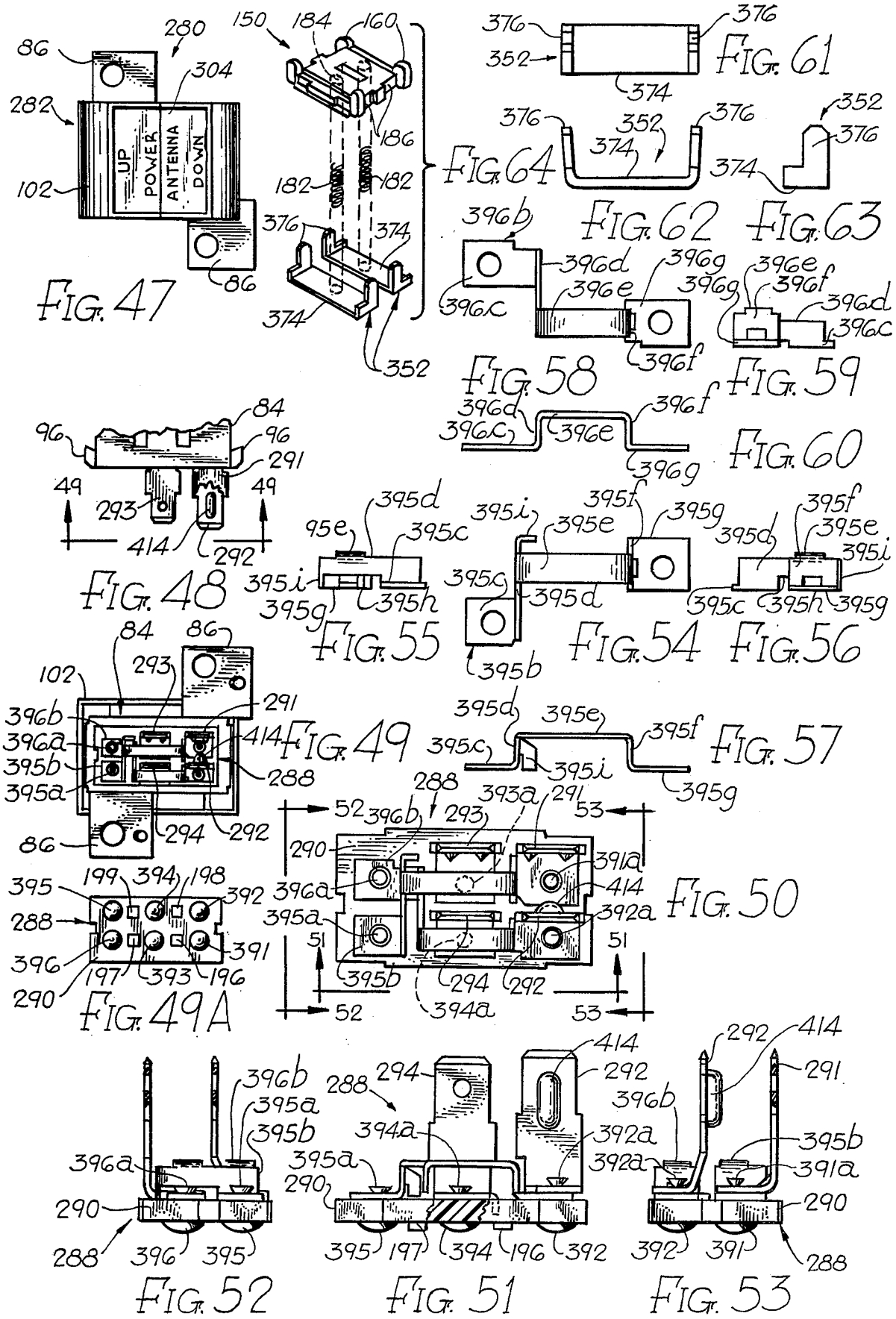

FIG. 47 is a front view of a modified rocker switch, to be described as a second embodiment of the present invention.

FIG. 48 is a fragmentary side view, showing the terminal arrangement of the switch of FIG. 47.

FIG. 49 is a rear view of the switch of FIG. 47.

FIG. 49A is a front view of the terminal head assembly for the switch of FIG. 47.

FIG. 50 is an enlarged rear view of the terminal head assembly for the switch of FIG. 47.

FIG. 51 is an enlarged side view, taken generally as indicated by the line 51—51 in FIG. 50.

FIGS. 52 and 53 are opposite end views of the terminal head of FIG. 50, taken generally as indicated by the lines 52—52 and 53—53 in FIG. 50.

FIG. 54 is a rear view of one of the crossover bars for the terminal head assembly of FIG. 50.

FIGS. 55 and 56 are opposite end views of the crossover bar of FIG. 54.

FIG. 57 is a side view of the crossover bar of FIG. 54.

FIG. 58 is a rear view of the other crossover bar for the terminal head assembly of FIG. 50.

FIGS. 59 and 60 are end and side views of the crossover bar of FIG. 58.

FIGS. 61, 62 and 63 are front, side and end views of one of the contactors for the switch of FIG. 47.

FIG. 64 is an exploded perspective view showing the contactors, the contactor springs and the carriage for the switch of FIG. 47.

FIG. 65 is a front view of another modified rocker switch, to be described as a third illustrative embodiment of the present invention.

FIG. 66 is a fragmentary side view, showing the terminal arrangement for the switch of FIG. 65. FIG. 67 is a rear view of the switch of FIG. 65.

FIGS. 68, 69, 70 and 71 are rear, side and opposite end views of the terminal head assembly for the switch of FIG. 65.

FIGS. 72 and 73 are side and front views of a connector adapted to be connected to the switch of FIG. 65.

FIGS. 74 and 75 are side and front views of a connector, adapted to be connected to the switch of FIGS. 47–64.

As previously indicated, FIG. 1 illustrates a rocker switch 80 to be described as an illustrative embodiment of the present invention. The switch 80 has rocker means in the form of a rocker assembly 82 for operating the switch. The rocker assembly 82 is rockably mounted on a casing 84, which may be generally rectangular in shape. Both the rocker assembly 82 and the casing 84 may be made of a resilient resinous plastic material which may be molded into the desired shape.

The rocker switch 80 is especially well adapted for automotive service, but will find many other applications. In this case, as shown in FIG. 5, the intended function of the switch 80 is indicated by the legend "REAR DEFOG" and the words "ON" and "OFF" displayed on the rocker assembly 82.

The illustrated casing 84 has a pair of laterally extending bracket arms 86 for mounting the casing 84 behind a panel or the like. The rocker assembly 82 is rockably mounted on the front of the casing 84. The rear portion of the casing 84 supports a terminal head assembly 88, which in this case comprises an insulating terminal board or plate 90 on which a plurality of terminals are mounted. Various terminal arrangements may be provided, but the illustrated switch 80 comprises four terminals 91, 92, 93 and 94, as shown in FIG. 6. The terminals 91–94 are adapted to receive a suitable connector, not shown. The arrangement of the terminals 91–94 is non-symmetrical, so that the connector cannot be reversely mounted on the terminals.

The rear portion of the illustrated casing 84 is formed with a pair of lugs 96 for interlocking engagement with catch fingers on the connector, to retain the connector and to prevent it from being accidentally disconnected from the terminals 91–94 of the switch 80.

As shown in FIGS. 8, 8A and 9, and also in FIGS. 43–46, the illustrated rocker assembly 82 is made in three parts, comprising a rocker base or plate 100, a cover shell 102 and an insert 104. The rocker base or plate 100 is rockably mounted on the casing 84, while the cover shell 102 serves as a front cover for the rocker plate 100 and is securely mounted thereon, for rocking movement therewith. The insert 104 snaps into the front of the cover shell 102 and serves to carry the legends "REAR DEFOG," "ON" and "OFF," previously referred to. Thus, the rocker assembly 82 can be provided with various inserts carrying different legends to adapt the rocker assembly for use with various modified versions of the switch. All three components 100, 102 and 104 are preferably made of a resilient resinous plastic material. However, the cover shell 102 may be given a decorative finish, such as chrome plating, for example.

For easy assembly, the illustrated rocker plate 100 is formed with a plurality of forwardly projecting hooked catch fingers 106, adapted to snap into interlocking engagement with lugs 108 which are formed inside the cover shell 102. In this case, there are four of the hooked fingers 106, which are sufficiently flexible and resilient to snap past the lugs 108. Thus, the rocker plate 100 and the cover shell 102 can be assembled very easily, simply by pushing these components together.

The inert 104 is in the shape of a thin bent plate, adapted to be inserted into a forwardly facing seat 110 (FIG. 43), to close a corresponding opening in the front of the cover shell 102. The four corners of the illustrated insert plate 104 are formed with tabs 112, adapted to snap into interlocking engagement with corresponding recesses 114 in the cover shell 102.

Means are provided for pivotally mounting the rocker base or plate 100 on the casing 84.

As shown in FIG. 9, and also in FIGS. 20–24, the rocker plate 100 is provided with a pair of pivots 118 in the form of circular projections or trunions, formed on flexible resilient pivot supporting arms 120, projecting rearwardly from the rocker plate 100. The pivots 118 are adapted to be pivotally received in openings 122, formed in a pair of side walls 124 on the casing 84, as shown in FIGS. 10 and 25–30. To assist in snapping the pivots 118 into the openings 122, the pivots 118 are formed with oppositely inclined ramps 126, as shown to best advantage in FIGS. 9 and 22. The side walls 124 are also preferably formed with ramps 128, as shown in FIGS. 10, 26 and 30. The ramps 126 and 128 make it easy to snap the pivots 118 into the openings 122 by pushing the pivots 118 into the front end of the casing 84. The action of the ramps 126 and 128 causes sufficient flexure of the pivot supporting arms 120 to provide for the insertion of the pivots 118 into the openings 120.

In order to support the pivots 118, the casing walls 124 are formed with cylindrically curved bearings or abutments 130, aligned with the rear boundaries of the openings 122.

FIGS. 43–45 show the manner in which the rocker assembly 82 is swingable in opposite directions, between the extreme positions of FIGS. 44 and 45. The rocking movement of the rocker assembly 82 is limited by engagement of the rocker base or plate 100 with oppositely inclined stop surfaces 134 and 136 on the casing 84. The rear side of the rocker plate 100 is engageable with the stop surfaces 134 and 136.

The rocker plate 100 is formed with reinforcing ribs 138, 140 and 142, which have the effect of stiffening and strengthening the rocker plate. These ribs 138, 140 and 142 project forwardly from the rocker plate 100 and extend transversely relative to the rocking axis.

To operate the switch 80, the rocker plate 100 is formed with a rearwardly projecting lever arm 142, as shown in FIGS. 9 and 21–24. The lever arm 142 is preferably molded in one piece with the rocker plate 100.

As shown in FIGS. 21, 22 and 24, the illustrated lever arm 142 is provided with a reinforcing rib 144 which stiffens and strengthens the lever arm. At its rear end, the lever 142 has a tip portion 146 with a pair of rounded edge portions 148.

As clearly shown in FIGS. 43–45, the lever arm 142 is adapted to move a carriage 150 on which a contactor 152 is mounted. Details of the carriage 150 are shown in FIGS. 38–41. The contactor 152 is shown in FIGS. 35–37.

As shown in FIGS. 43–45, the carriage 150 is slidable along an intermediate transverse wall 154, extending across the inside of the casing 84. To convert the swinging movement of the lever arm 142 into the sliding movement of the carriage 150, the tip portion 146 of the lever arm is slidably and rockably received in a slot 156, formed in the carriage 150. The lever 142 extends through an elongated clearance slot 158 in the casing wall or partition 154. The rounded edge portions 148 of the lever arm 142 have a rocking and sliding engagement with corresponding walls of the slot 156 in the carriage 150.

It is preferred to provide detent means for detaining and locating the carriage 150 in one or more operating positions. Such detent means may comprise a plurality of detent bumps or projections 160 projecting forwardly from the front side of the carriage 150, four such bumps 160 being provided in this instance, as illustrated in FIGS. 39 and 40.

The carriage 150 has a central position, as shown in FIG. 43, in which the detent bumps 160 are detained and located in detent recesses or seats 162, formed between detent ramps 164 and 166 (FIGS. 27 and 30). The carriage 150 is adapted to be moved in opposite directions from the central position, as shown in FIGS. 44 and 45. When the carriage 150 is moved in either direction, two of the detent bumps 160 ride up the ramps 164 to a central plateau 168. The other two detent pumps 160 ride up the ramps 166, and then down oppositely sloping ramps 170, which tend to detain and locate the carriage 150 in its displaced positions. The various detent elements 162–170 are formed on the rear side of the wall or partition 154 in the casing 84. It will be understood that various other detent arrangements may be provided.

The carriage 150 is preferably made of an electrically insulating material, such as a suitable moldable resinous plastic material. The contactor 152 is made of an electrically conductive material, such as copper, for example.

As shown in FIGS. 35–37, the illustrated contactor 152 is in the form of a substantially flat metal plate 174 having guide tabs or fingers 176 bent forwardly therefrom, four such tabs 176 being provided in this instance. The contactor 152 is mounted on the carriage 150 for movement therewith in opposite lateral directions from its central position, as shown in FIGS. 43–45. The contactor 152 is selectively engageable with forwardly facing contact means 180 in the casing 84. Preferably, the contact 152 is biased rearwardly against the contact means 180, such biasing action being provided by a pair of contactor springs 182 in this instance, as shown to best advantage in FIG. 11. The illustrated springs 182 are in the form of coil springs, compressed between the carriage 150 and the contactor 152. Spring sockets or recesses 184 are preferably formed in the carriage 150, as shown in FIG. 38, to receive and locate the compression coil springs 182.

To provide for relative movement between the carriage 150 and the contactor 152 in forward and rearward directions, the guide tabs 176 on the contactor 152 are slidably received in slots or grooves 186, formed in the carriage 150. The guide tabs 176 preferably fit freely in the grooves 186 to provide for easy rocking and sliding movement of the contactor 152 relative to the carriage 150.

The contact means 180 may be arranged in various ways to provide a variety of switching functions. In this case, the contact means 180 are provided by the previously mentioned terminal head assembly 88, with its insulating board 90 and terminals 91–94. The illustrated contact means 180 take the form of rounded contact points 191, 192 and 193, which may be formed by the heads of rivets **191*a*, 192*a* and 193*a*, to which the terminals 91, 92 and 93 are connected, as shown in FIGS. 31–34. The rivets 191*a*, 192*a* and 193*a* extend through the insulating board 90, and also through the mounting flanges of the terminals 91, 92 and 93. The fourth terminal 94 is secured to the insulating board 90 by a fourth rivet 194 which is not engageable by the contactor 152**.

It will be seen that the illustrated contact points 191, 192 and 193 are aligned along the path of movement of the contactor 152. When the contactor 152 is in its central or neutral position, the contactor engages the contact point 192 only, so that no circuit is established by the contactor. When the contactor 152 is moved to the left to one extreme position, as shown in FIG. 44, the contactor engages the contacts 192 and 193, so as to establish a circuit between the terminals 92 and 93. Movement of the contactor 152 to the right, to its other extreme position, as shown in FIG. 45, causes the contactor to engage the contact points 191 and 192, so that a circuit is established between the terminals 91 and 92.

As shown in FIG. 12, it is preferred to provide insulating points or bosses 196, 197, 198 and 199, projecting forwardly from the insulating board 90, to stabilize the sliding movement of the contactor 152, and to prevent the contactor from engaging the rivet 194. The insulating bosses 196–9 may be molded in one piece with the insulating board 90, or may be formed from the board 90 as semi-perforations. As shown, the insulating boss 196 projects forwardly from the board 90 between the contact points 191 and 192. The insulating boss 197 is disposed on the board 90 between the contact points 192 and 193. The insulating bosses 198 and 199 are spaced laterally on the insulating board 90 from the insulating bosses 196 and 197, respectively, and are generally aligned with the rivet 194. As shown to best advantage in FIGS. 43–45, the contact points 191–193 project forwardly from the board 90 to a somewhat greater extent than the insulating bosses 196–199, so that the contactor 152 will not engage the insulating bosses when the contactor is engaging two of the contact points 191–193.

A circuit diagram for the switch 80 is shown by way of example in FIG. 42. As shown, the terminal 91 is connected to an electrical power source, which may deliver 12 volts DC, relative to ground, as indicated by the legend in FIG. 42. The terminal 92 may be connected to the control circuit of a relay or the like, not shown. In this case, the terminal 93 is connected to ground. The terminal 94 may be connected to the ungrounded side of the device to be energized. For example, such device may be the rear window defogging device of an automobile. As shown, an indicator lamp 202 may be connected between the terminals 93 and 94, to provide a visual indication when the terminal 94 is energized. In this case, a diode 204 is connected between the terminals 91 and 92.

As shown in FIG. 31, the diode 204 is incorporated into the terminal head assembly 88 and is connected between the rivets 191*a* and 192*a*. As diagrammatically illustrated in FIG. 33, the lamp 202 is preferably included as a component of the switch 80 and is provided with wire leads 213 and 214, connected to terminal lugs 213*a* and 214*a* which are mounted on the rivets 193*a* and 194. The leads 213 and 214 are preferably soldered to the terminal lugs 213*a* and 214*a*.

As shown in FIG. 7, the indicator lamp 202 is preferably mounted within the front portion of the casing 84, just behind the rocker assembly 82. In the illustrated construction, the indicator lamp 202 is frictionally retained in a generally cylindrical socket member 216, formed in the casing 84. The wire leads 213 and 214 for the lamp 202 extend rearwardly from the lamp 202 to the terminal lugs 213*a* and 214*a* on the terminal head assembly 88.

The indicator lamp 202 is adapted to illuminate the interior of the rocker assembly 82. As shown in FIG. 9, the rocker base or plate 100 is formed with an opening 218, disposed in front of the lamp 202, so that the light from the lamp 202 will be transmitted through the opening 218 to the interior of the cover shell 102. The walls of the cover shell 102 preferably include a light transmitting element or portion, so that the light from the lamp 202 will be visible to the operator. In the illustrated construction, as shown in FIG. 8*a*, the light transmitting element takes the form of a light transmitting lens or jewel 220, which is mounted in an opening in the insert 104. As shown in FIGS. 13–15, the illustrated lens or jewel 220 is generally rectangular in cross-section and is adapted to snap into a correspondingly shaped rectangular opening 222 in the insert 104. The illustrated lens 220 has a front flange 224 which is engageable with the front of the insert 104. The lens 220 has a generally rectangular body 226, adapted to be mounted within the opening 222. Transverse detent ribs 228 project outwardly from the body 226 and are adapted to be snapped through the opening 222 with a force fit. Ramps 230 are provided behind the detent ribs 228 to assist in the insertion of the lens 220 into the opening 222.

The detent ribs 228 are formed on the narrower sides 232 of the rectangular body 226. The wider sides 234 are formed with ribs 236 which are cylindrically curved in cross section and are adapted to be frictionally fitted into the opening 222 in the insert 104, so as to prevent any rattling of the lens 220.

It will be understood that the lens or jewel 220 provides a bright spot of light on the rocker assembly 82 when the indicator lamp 202 is lighted. The lens 220 may be any desired color, such as green, for example.

In certain versions of the switch 80, it is desirable to provide a return spring arrangement which returns the rocker assembly 82 to its central or neutral position, as shown in FIG. 43. Such return spring action provides a resilient biasing force which resists the swinging movement of the rocker assembly 82 to its extreme positions, as shown in FIGS. 44 and 45, and is effective to return the rocker assembly to its central position when the operating force on the rocker assembly 82 is released by the operator.

As shown in FIGS. 18, 19 and 43–46, the rocker switch 80 comprises a torsion return spring 40, which may be employ a length of spring wire, formed into a wire coil 242, having two end arms 244 and 246. The torsion spring 240 is preferably mounted within the front portion of the casing 84, as shown in FIGS. 43–46, and also in FIG. 10.

The interior of the casing 84 is provided with a pocket formation 248 adapted to receive and locate the wire coil 242. The pocket formation 248 is adjacent one of the side walls 124 of the casing 84.

The illustrated casing 84 is provided with a pair of opposite end walls 250 which are formed with elongated slots 252 for receiving and retaining the end arms 244 and 246 of the spring 240. It is necessary to prestress the spring 240, in order to insert the end arms 244 and 246 into the slots 252. After the spring 240 has been installed, it remains in a prestressed condition, with the end arms 244 and 246 resiliently biased against the front ends of the slots 252, as shown in FIGS. 10 and 46. The force of the spring 240 biases the wire coil 242 into the pocket 248.

In the illustrated construction, the rocker base or plate 100 is employed to operate the return spring 240. As shown in FIGS. 9 and 46, the rocker plate 100 has a pair of rearwardly projecting spring operating tabs or fingers 254 and 256, for engaging the end arms 244 and 246 of the spring 240. The spring operating tabs 254 and 256 project rearwardly into the casing 84 and are close to and actually engaged with the end arms 244 and 246 when the rocker assembly 82 is in its center or neutral position, as shown in FIGS. 43 and 46. To avoid rattling of the rocker assembly 82, there should be very little or no play between the spring operating tabs 254 and 256 and the spring end arms 244 and 246.

When the rocker assembly 82 is swung in one direction, such as clockwise, as shown in FIG. 44, the spring operating tab 254 pushes the end arm 244 rearwardly, against the resilient force of the return spring 240. Thus, the force of the spring 240 causes the rocker assembly 82 to return to its center or neutral position, when the operator no longer exerts an operating force on the rocker assembly.

When the rocker assembly 82 is swung in a counterclockwise direction, as shown in FIG. 45, the other spring operating tab 256 pushes the other end arm 246 rearwardly against the resilient biasing force of the spring 240. Thus, the spring 240 causes the rocker assembly 82 to return to its center position when it is released by the operator. The force of the return spring 240 is great enough to overcome the detent action caused by the engagement of the detent bumps 160 with the detent ramps 170. Thus, the carriage 150 of the switch 80 returns to its center position with a snap action.

The contactor springs 182 provide contact pressure between the contactor 152 and the contact points 191–193. In addition, the springs 182 provide a spring detent force, biasing the detent bumps 160 into firm engagement with the detent elements 162–170 on the partition or wall 154 in the casing 84.

The terminal head assembly 88 is adapted to be pushed into place in the rear portion of the casing 84, which has a rectangular opening 270 (FIGS. 29 and 30) dimensioned to receive the insulating terminal board 90. In its fully installed position, the terminal board 90 seats against a shoulder 272 with a snap action and is retained by a plurality of teeth or lugs 274, having a shape similar to ratchet teeth, with ramps 276 on the rear portions of the teeth 274 to assist in insertion of the terminal board 90 by pushing it forwardly, past the teeth 274. The teeth 274 are supported by casing side walls 278 which are sufficiently flexible and resilient to permit the insertion of the terminal board. When the terminal board 90 is pushed forwardly past the teeth 274, the side walls 278 are deflected outwardly. When the terminal board 90 is fully seated against the shoulder 272, the resilience of the side walls 278 causes the teeth 274 to snap behind the terminal board 90 so that it is securely retained in the casing 84.

FIGS. 49–64 illustrate a modified rocker switch 280 which incorporates most of the features of the rocker switch 80 of FIGS. 1–46, but with differences to be described presently. Except as described and illustrated, the modified switch 280 may be the same as the switch 80, previously described and illustrated.

As shown in FIG. 47, the modified rocker switch 280 has a slightly modified rocker assembly 282, utilizing the same cover shell 202 as before, but with a slightly modified insert 304, which displays the legend "POWER ANTENNA," along with the words "UP" and "DOWN." These legends indicate that the switch 280 is intended to be used for controlling the upward and downward movement of a power antenna. This particular switch 280 is not equipped with the internal indicator lamp 202. Accordingly, the insert 304 is not fitted with the light transmitting lens or jewel 220. Otherwise, the rocker assembly 282 and the insert 304 are the same as the corresponding components 82 and 104, previously described in connection with FIGS. 1–46.

As shown in FIGS. 48–53, the modified rocker switch 280 has a modified terminal arrangement, involving a modified terminal head assembly 288, including an insulating terminal board 290, with four terminals 291, 292, 293 and 294 mounted thereon. As will be described in detail presently, the terminal head assembly 288 includes six contact points which are selectively engageable by two contactors 352, which replace the single contactor 152 of the rocker switch 80, previously described in connection with FIGS. 1–46. The contactors 352 are mounted side by side on the carriage 150, which is the same as previously described.

Each contactor 352 is made of an electrically conductive material, such as copper, for example. Each contactor 352 comprises a flat elongated plate 374 having guide tabs or fingers 376 bent forwardly therefrom. Individually, the guide tabs 376 are the same as the guide tabs 176, previously described. The guide tabs 376 are slidably received in the grooves or slots 186 on the carriage 150.

The contactor springs 182 are the same as previously described. Each spring 182 is compressed between the carriage 150 and one of the contactors 352, so that the contactors are resiliently biased into engagement with the contact points on the terminal head assembly 288.

As shown in FIGS. 47–53, the rocker switch 280 has its contact structure arranged to produce a double pole double throw reversing switch. Thus, as shown in FIG. 49A, the terminal head assembly 288 includes six contact points 391, 392, 393, 394, 395 and 396, mounted on the insulating board 290. The contact points 391–396 are arranged in two longitudinal rows for engagement by the two contactors 352. In the central or neutral position of the carriage 150, one contactor 352 engages the contact point 393, while the other contactor 352 engages the contact point 394. When the contactors 352 are moved in one direction from the neutral position, one contactor 352 engages the contacts 391 and 393, while the other contactor 352 engages the contact points 392 and 394. If the contactors 352 are moved in the opposite direction from the neutral position, one contactor 352 engages the contact points 393 and 396, while the other contactor 352 engages the contact points 394 and 395.

The contact points 391–396 may be formed as the spherically rounded heads of rivets 391*a*–396*a*, extending through the insulating terminal board 290. The rivets 391*a*, 392*a*, 393*a* and 394*a* are connected directly to the terminals 291, 292, 293 and 294, in this instance, as shown in FIGS. 50–53. The rivets 395*a* and 396*a* are connected by means of cross-over conductors 395*b* and 396*b* to the terminals 291 and 292, respectively. Thus, the rocker switch 280 has a central OFF position and two ON positions, with a reversal of polarity between the two ON positions.

As shown in FIGS. 54–56, the crossover conductor 395*b* is in the form of a bar or strap, made of sheet metal or the like. As shown, the crossover bar 395*b* comprises an apertured end flange 395*c*, adapted to receive the rivet 395*a*; a rearwardly bent leg 395*d* which also extends laterally; a longitudinally bent leg 395*e* which is spaced rearwardly from the rivet 393*a*, to avoid any contact therewith; a forwardly bent leg 395*f*; and a longitudinally bent end flange 395*g* which is apertured to receive the rivet 391*a*. The leg 395*d* has a notch or cutout 395*h* where such leg is near the other crossover conductor 396*b*, to obviate any contact therewith; and also a generally L-shaped foot or flange 395*i* which extends longitudinally and forwardly to the rear side of the terminal board 90 to prevent any accidental bending of the legs 395*d* and 395*e* into engagement with the crossover conductor 396*b*.

The other crossover conductor 396*b* is also in the form of a bar or strap having an end flange 396*c* which is apertured to receive the rivet 396*a*; a rearwardly bent leg 396*d* which also extends laterally; a longitudinally bent leg 396*e* which is spaced rearwardly from the rivet 394*a* to avoid any contact therewith; a forwardly bent leg 396*f*; and an end flange 396*g* which is apertured to receive the rivet 392*a*. The end flange 396*c* extends through the cutout 395*h* and thus is spaced forwardly from the leg 395*d*. The rear edge of the leg 396*d* is spaced forwardly from the leg 395*e*. The crossover conductor 396*b* may also be made of sheet metal or the like.

Except as described and illustrated in FIGS. 47–64, the rocker switch 280 may be the same as the previously described switch 80 of FIGS. 1–46. To the extent that the switch 280 is the same as the switch 80, the same reference characters have been employed, so that the previous description will readily be applicable.

In a typical application, the terminals 293 and 294 of the switch 290 may be connected to the positive and negative terminals of an automotive storage battery circuit, while the terminals 291 and 292 may be connected to the armature of a direct current electrical motor having a permanent magnet field. When the rocker assembly 282 is in its center or neutral position, the contactors 352 engage the contact points 393 and 394 only, so that the motor is turned off.

When the rocker assembly 282 is rocked in one direction, the contactors 352 complete two circuits: the first between the contact points 391 and 393; and the second between the contact points 392 and 394. Thus, the motor is energized with voltage of one polarity and may be effective to move the power antenna up.

When the rocker assembly 282 is rocked in the opposite direction, the contactors 352 establish two different circuits: The first between the contact points 393 and 396; and the second between the contact points 394 and 395. Due to the crossover conductors 395*b* and 396*b*, the motor is supplied with voltage of the opposite polarity and thus is effective to move the power antenna down. When the rocker assembly 282 is released, it is returned to its centered position by the return spring 240, the same as in the case of the rocker switch 80.

FIGS. 74 and 75 illustrate a connector 400 for use with the rocker switch 280 of FIGS. 47–64. The connector 400 has four receptable contacts 401–404 for receiving and engaging the terminals 291–294. The receptacle contacts 401–404 are mounted in an insulating connector body 406 and are connected to a series of wire leads 408.

In the illustrated construction, as shown in FIG. 74, the ends of the connector body 406 are provided with flexible resilient forwardly projecting fingers or arms 410 having catch hooks or teeth 412 thereon, adapted to snap behind the lugs 96 on the switch casing 84. In this way, the connector 400 is retained on the switch 280 against accidental disconnection.

To prevent any possibility of reversely mounting the connector 400 on the terminals 291–294, it is preferred to form one of the terminals with a laterally projecting blocking lug or key 414, which in this case is on the terminal 292. The illustrated terminals 291–294 are made of sheet metal, and the blocking lug 414 is in the form of a bathtub shaped boss, which is stamped or pressed from the sheet metal of the terminal 292. To receive the blocking lug or key 414, the electrically insulating material of the connector body 406 is formed with a slot 416 which is disposed between the receptacle contacts 401 and 402. On the other hand, the connector body 406 is formed with a solid blocking member 418 between the receptacle contacts 403 and 404. Thus, the blocking lug 414 must be aligned with the slot 416 in order to mount the connector 400 on the terminals 291–294. If an attempt is made to reverse the orientation of the connector body 406, the blocking lug 414 will strike the solid insulating member 418 so that the connector 400 cannot be reversely mounted.

FIGS. 65–73 illustrate another modified rocker switch 480 which is similar in most respects to the switch 80 of FIGS. 1–46. To the extent that the rocker switches 480 and 80 are the same, the same reference characters will be used so that the previous description will be readily applicable.

The modified rocker switch 480 of FIG. 65 has a slightly modified rocker assembly 482 which includes a slightly modified insert 504, on which the legend "REAR DEFOG" is displayed, along with the legends "HI" and "LO." The switch 480 does not employ the internal indicator lamp 202. Thus, the insert 504 does not have the light transmitting lens 220. Otherwise, the insert 504 is the same as the insert 104 of FIGS. 1–46.

The modified rocker switch 480 of FIGS. 65–73 has the same contact arrangement as the switch 80, but has a slightly modified terminal arrangement, comprising three terminals 591, 592 and 593, mounted on the rivets 191*a*, 192*a* and 193, and thus connected to the contact points 191, 192 and 193. The illustrated terminals 591, 592 and 593 are aligned longitudinally. The fourth terminal 94 of the switch 80 is not used in the modified switch 480.

Internally, the modified switch 480 is the same as the switch 80, except that the indicator lamp 202 and the return spring 240 are omitted and are not used. The diode 204 is also omitted.

Because of the omission of the return spring, the rocker assembly 482 has three detented positions, without any spring return action.

FIGS. 72 and 73 illustrate a connector 600 for use with the rocker switch 480. The connector 600 has three receptacle contacts 601, 602 and 603, mounted in an insulating body 606, and adapted to receive the terminals 591, 592 and 593. The connector 600 may be retained on the switch 480 by the same resilient retainer arms 410 and hooks 412, as described in connection with FIGS. 74 and 75.

To prevent any possibility of reversely mounting the connector 600 on the terminals 591–593, one of the terminals is preferably provided with a blocking lug or key 614, similar to the lug 414 of FIGS. 74 and 75. In this case, the blocking lug or key 614 is formed on the terminal 592. As before, the blocking lug 614 is generally bathtub shaped and is stamped or pressed from the sheet metal of the terminal 592.

To receive the blocking lug 614, one side portion of the insulating connector body 606 is formed with a slot 616. The other side of the connector body 606 is formed with a solid wall portion 618 which will engage the blocking lug 614 if any attempt is made to mount the connector 606 reversely on the terminals 591–593. Thus, reverse mounting is positively prevented. As shown, wire leads 621, 622 and 623 are connected to the receptacle contacts 601, 602 and 603.

Except as described and illustrated, the rocker switch 480 may be the same as the previously described rocker switch 80.

In the rocker switch 80 of FIGS. 1–46, the light transmitting opening 218 in the rocker plate 100 also provides mechanical clearance for the lamp 202, so that the rocker plate 100 will not engage the lamp 202. Thus, breakage of the lamp 202 is obviated.

In the disclosed switches, the cover shell 102 provides a front cover for the rocker plate 100, and also for the front portion of the casing 84.

We claim:

1. An electrical switch, comprising a casing, a carriage movable in said casing, contactor means mounted on said carriage and movable therewith, contact means in said casing and selectively engageable by said contactor means, a rocker plate rockably mounted on said casing and having a lever arm swingable with said rocker plate and engaging said carriage for causing movement of said carriage in response to rocking movement of said rocker plate, a pair of spaced generally parallel side walls on said casing and having pivot-receiving openings in said side walls, a pair of flexible resilient generally parallel pivot-supporting tabs projecting rearwardly from said rocker plate, a pair of pivot elements on said respective pivot-supporting tabs and pivotally received in said openings for rockably supporting said rocker plate, said pivot elements being insertable into said openings by flexure of said flexible resilient tabs, a torsion return spring comprising a length of wire formed into a coil with opposite end arms extending from said coil, said casing having a pocket formation for receiving said coil and slot formations for receiving said end arms with said spring prestressed, and a pair of spring-operating tabs on said rocker plate for engaging and swinging said opposite end arms of said spring when said rocker plate is swung in opposite directions from a central position.

2. An electrical switch, comprising a casing, a carriage movable in said casing, contactor means mounted on said carriage and movable therewith, contact means in said casing and selectively engageable by said contactor means, a rocker plate rockably mounted on said casing and having a lever arm swingable with said rocker plate and engaging said carriage for causing movement of said carriage in response to rocking movement of said rocker plate, said casing having a front portion for supporting said rocker plate, pivot means rockably supporting said rocker plate on said front portion of said casing, a torsion return spring comprising a length of wire formed into a coil with opposite end arms extending from said coil, said casing having a pocket formation for receiving said coil and slot formation for receiving said end arms with said spring prestressed, and a pair of spring-operating tabs on said rocker plate for engaging and swinging said opposite end arms of said spring when said rocker plate is swung in opposite directions from a central position.

3. An electrical switch according to claim 2, including a cover shell mounted on said rocker plate in front of said rocker plate and covering said rocker plate and said front portion of said casing.

4. An electrical switch, comprising a casing, contactor means movable in said casing, contact means in said casing and selectively engageable by said contactor means, a rocker member rockably mounted on said casing and having means swingable with said rocker member for causing movement of said contactor means in response to rocking movement of said rocker member, said casing having a front portion for supporting said rocker member, pivot means rockably supporting said rocker member on said front portion of said casing, a torsion return spring comprising a length of wire formed into a coil with opposite end arms extending from said coil, said casing having a pocket formation for receiving said coil and slot formation for receiving said end arms with said spring prestressed, and a pair of spring-operating tabs on said rocker member for engaging and swinging said opposite end arms of said spring when said rocker member is swung in opposite directions from a central position.

* * * * *